US009115703B2

(12) United States Patent
Loewe et al.

(10) Patent No.: US 9,115,703 B2
(45) Date of Patent: Aug. 25, 2015

(54) ADJUSTABLE HYDRAULIC PUMP

(71) Applicant: Robert Bosch GmbH, Stuttgart (DE)

(72) Inventors: Peter Loewe, Burgrieden (DE); Thomas Froehlich, Beimerstetten (DE)

(73) Assignee: Robert Bosch GmbH, Stuttgart (DE)

( * ) Notice: Subject to any disclaimer, the term of this patent is extended or adjusted under 35 U.S.C. 154(b) by 346 days.

(21) Appl. No.: 13/746,898

(22) Filed: Jan. 22, 2013

(65) Prior Publication Data

US 2013/0189127 A1 Jul. 25, 2013

(51) Int. Cl.
*F04B 49/035* (2006.01)
*F04B 7/00* (2006.01)
*F04B 49/03* (2006.01)

(52) U.S. Cl.
CPC . *F04B 7/00* (2013.01); *F04B 49/03* (2013.01); *F04B 49/035* (2013.01)

(58) Field of Classification Search
CPC ..... F04B 7/00; F04B 49/03; F04B 49/035; F04B 1/303; F04B 1/324
See application file for complete search history.

(56) References Cited

U.S. PATENT DOCUMENTS

| | | | | | |
|---|---|---|---|---|---|
| 2,935,951 | A | * | 5/1960 | Forster | 417/3 |
| 3,784,327 | A | * | 1/1974 | Lonnemo | 417/222.1 |
| 3,784,328 | A | * | 1/1974 | Pedersen | 417/222.1 |
| 4,008,004 | A | * | 2/1977 | Shaw | 417/216 |
| 4,017,219 | A | * | 4/1977 | Born et al. | 417/216 |
| 4,029,439 | A | * | 6/1977 | Adams | 417/216 |

FOREIGN PATENT DOCUMENTS

| | | |
|---|---|---|
| DE | 198 50 611 C1 | 5/2000 |
| DE | 10 2008 038 435 A1 | 2/2009 |

* cited by examiner

*Primary Examiner* — Bryan Lettman
(74) *Attorney, Agent, or Firm* — Maginot, Moore & Beck LLP

(57) ABSTRACT

A hydraulic pump includes an adjustment device configured to adjust a delivery volume. The adjustment device is configured to be connected via a shuttle valve to a control pressure supply and to a working line. The working line is supplied by the hydraulic pump. The adjustment device is configured to be alternately supplied with control pressure by the control pressure supply and by the hydraulic pump. The hydraulic pump also includes a nozzle. The nozzle is configured to connect the working line to the control pressure supply in a zero stroke operating mode. The nozzle is formed in or on a valve body of the shuttle valve.

11 Claims, 2 Drawing Sheets

ADJUSTABLE HYDRAULIC PUMP

This application claims priority under 35 U.S.C. §119 to patent application no. DE 10 2012 001 369.8, filed on Jan. 25, 2012 in Germany, the disclosure of which is incorporated herein by reference in its entirety.

BACKGROUND

The disclosure relates to an adjustable hydraulic pump according to the description below.

In adjustable hydraulic pumps, what is referred to as a zero stroke operating mode can lead to problems, in particular if said operating mode lasts for a relatively long time. This zero stroke operating mode occurs, for example, when a consumer which is supplied by the hydraulic pump is not to be operated for a relatively long time and in the process the hydraulic pump continues to be driven in a rotating fashion.

In order to ensure a minimum throughput of pressure medium in order to lubricate a hydraulic pump, it is known from the prior art to operate the hydraulic pump with a minimum stroke in order to deliver a minimum amount of pressure medium. This solution is subject to tolerances and is dependent on temperature and leakage.

Documents DE 198 50 611 C1 and DE 10 2008 038 435 A1 present an adjustable hydraulic pump in which the control pressure supply of the adjustment device can be provided, on the one hand, via a working line of the hydraulic pump, or, on the other hand, via a further "external" control pressure supply. The alternating connection to the respective control pressure source with a relatively high pressure is carried out here via a shuttle valve. A disadvantage of this solution is that the state of the shuttle valve is undefined when the pressure at its two inputs is equal. In this context, the shuttle valve can be closed and damaged. This can in turn lead to a failure of the adjustment device and to a failure of the hydraulic pump.

SUMMARY

In contrast with the above, the disclosure is based on the object of providing an adjustable hydraulic pump which can be operated in the zero stroke operating mode and whose adjustment device is connected via a shuttle valve to two different units for supplying control pressure medium, wherein the above-mentioned disadvantages are avoided.

This object is achieved by means of an adjustable hydraulic pump having the features described below.

The hydraulic pump according to the disclosure has an adjustment device for adjusting the delivery volume. For this purpose, the adjustment device can be connected via a shuttle valve to a control pressure supply and to a working line which is supplied by the hydraulic pump. Accordingly, the adjustment device can be alternately supplied with control pressure by the control pressure supply or by the hydraulic pump. A nozzle, via which the working line is continuously connected to the control pressure supply, is formed in or on a valve body of the shuttle valve. In the zero stroke operating mode of the hydraulic pump, the pressure in the working line drops in such a way that the pressure of the control pressure supply is predominant, and that the shuttle valve connects the control pressure supply to the adjustment device. According to the disclosure, via the nozzle, pressure medium is delivered from the control pressure supply via the open connection of the shuttle valve to the output connection thereof here, and further via the nozzle into the working line, with the result that a ram pressure, which loads the hydraulic pump, builds up in said working line. As a result, the leakage of the hydraulic pump is saturated and the hydraulic pump is lubricated. Therefore, even in the case of a zero stroke operating mode which lasts for a relatively long time, the hydraulic pump does not experience any direct damage due to a lack of lubrication and no indirect damage due to wear and failure of the shuttle valve after a relatively long undefined switched state.

Further advantageous refinements of the disclosure are described below.

In a first variant, the nozzle is formed by a drilled hole in the valve body. Such a nozzle can easily be fabricated and subsequently retrofitted into an already existing valve body of a shuttle valve from the prior art.

In one preferred development, the valve body has a longitudinal drilled hole, wherein the nozzle is formed by a radial drilled hole which is arranged in a central section of the valve body and which opens into the longitudinal drilled hole. Such a nozzle can easily be fabricated and subsequently retrofitted into an already existing valve body of a shuttle valve according to the prior art.

In one refinement, the valve body has a first conical section for controlling a first input connection, to which the control pressure supply is connected, and an adjacent first guide collar. According to the same principle, the valve body has a second conical section for controlling a second input connection to which the working line is connected, and an adjacent second guide collar. Seat valves, which ensure a reliable seal of the respectively closed input connection, are formed by means of the two conical sections. The central section is arranged between the two guide collars.

In one preferred development, the first guide collar has at least one radial flattened portion (recess), via which, in a first switched position of the valve body, a first pressure medium connection from the control pressure supply to the central section and therefore to an output connection of the shuttle valve, is formed. Accordingly, the second guide collar has at least one radial flattened portion (recess), via which, in a second switched position of the valve body, a pressure medium connection from the working line to the central section and therefore to the output connection of the shuttle valve is formed.

Preferably, three radial flattened portions are provided on each guide collar, wherein in each case three guide sections, which bear in a sliding fashion in a valve drilled hole of the shuttle valve, are formed between said radial flattened portions. As a result, resistance-free flow from the respective opened input connection to the output connection is possible and at the same time secure, tilt-free guidance of the valve body in the valve drilled hole is ensured.

In a second variant, the nozzle is formed by at least one notch on the valve body, in particular on the second conical section.

The control pressure supply preferably has a feed pump or external supply pump and a control pressure supply line. The feed pump is connected via the control pressure supply line to the first input connection of the shuttle valve.

The feed pump or external supply pump is preferably mechanically coupled to the hydraulic pump, with the result that the two pumps can be driven together by an external drive, for example by an internal combustion engine.

According to a first development of the control pressure supply, a pressure limiting valve is connected to the control pressure supply line, said pressure limiting valve being set, for example, to 30 bar, and the feed pump is a geared pump.

According to a second energy-saving development of the control pressure supply, the feed pump is an adjustment pump with pressure control.

In one advantageous embodiment of the adjustment device, said device has a first actuation cylinder which acts in the direction of increasing the delivery volume (in particular of a pivoting angle) of the hydraulic pump, and a second actuation cylinder which acts in the direction of reducing the delivery volume (in particular the pivoting angle) of the hydraulic pump. In this context, the first actuation cylinder is continuously connected to the output connection of the shuttle valve, while the second actuation cylinder can be connected to the output connection of the shuttle valve via a control valve.

In the case of preferred electro-proportional control, an actuation piston of the first actuation cylinder is coupled to a valve body of the control valve via a coupling spring. Mechanical feedback of the current pivoting angle and therefore of the current delivery volume of the hydraulic pump to the control valve is therefore provided.

BRIEF DESCRIPTION OF THE DRAWINGS

In the text which follows, an exemplary embodiment is described in detail with respect to the figures.

In the drawing.

DETAILED DESCRIPTION

Figure 1:
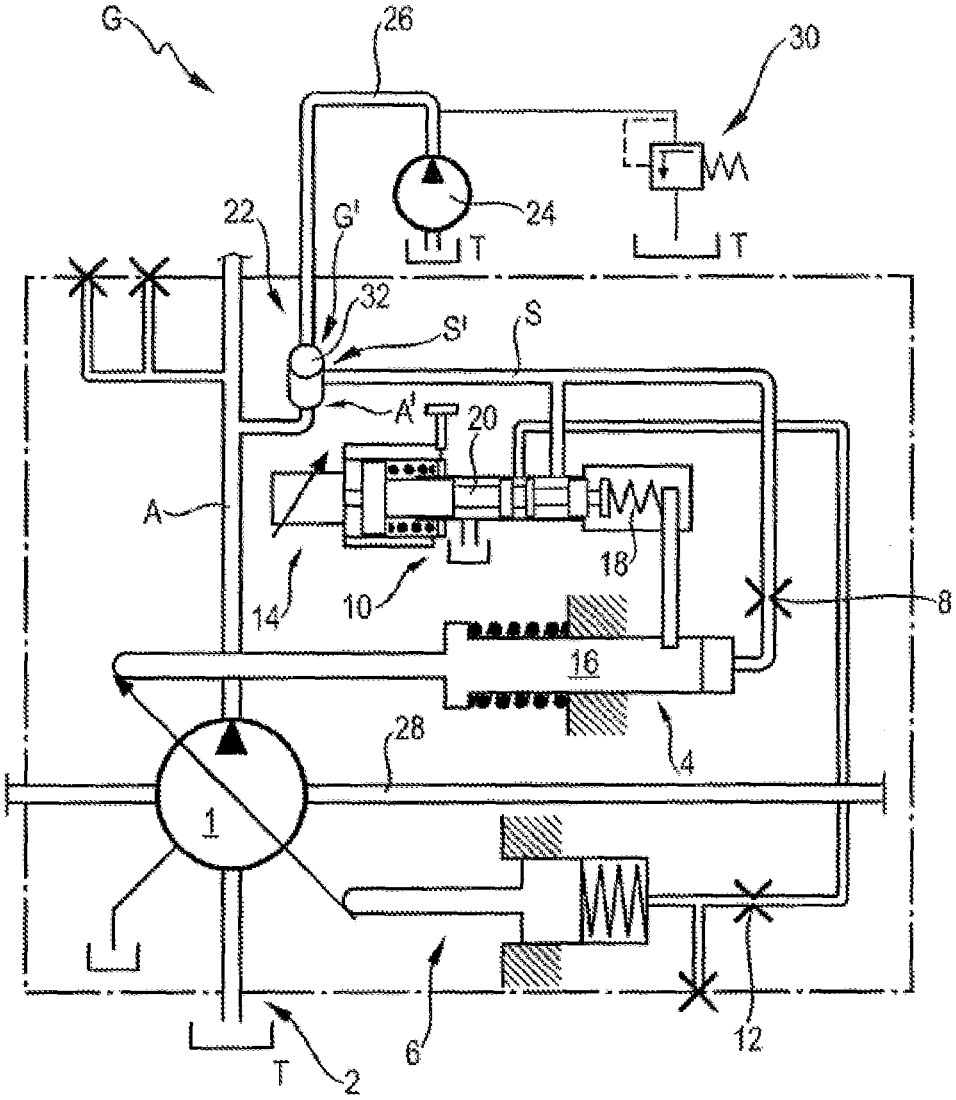
FIG. 1 shows a circuit diagram of the exemplary embodiment of the adjustable hydraulic pump according to the disclosure.

FIG. 1 shows a circuit diagram of the exemplary embodiment of a hydraulic pump according to the disclosure. Said hydraulic pump is operated in an open hydraulic circuit. In this context, the adjustable hydraulic pump 1 sucks in pressure medium from a tank T via a suction connection 2 and delivers it into a consumer (not shown) via a working line A and via a valve (likewise not shown). The consumer may be, for example, a working cylinder or a motor. The hydraulic pump has an adjustment device which has a first actuation cylinder 4 and a second actuation cylinder 6. The first actuation cylinder 4 acts in the direction of increasing a pivoting angle of the hydraulic pump 1, and is for this purpose connected to a control pressure line S via a restrictor 8. The second actuation cylinder 6 counteracts this is the direction of reducing the pivoting angle of the hydraulic pump 1, and is for this purpose connected to the control pressure line S via a control valve 10 and a restrictor 12. The control valve 10 has an electromagnet 14 via which the connection of the control pressure line S to the second actuation cylinder 6 can be adjusted in an electro-proportional fashion. In this context, mechanical feedback of the current pivoting angle is provided via an actuation piston 16 of the first actuation cylinder 4, and via a coupling spring 18 to a valve body 20 of the control valve 10. As a result, the actuation force which is to be applied by the electromagnet 14 is dependent on the current pivoting angle of the hydraulic pump 1.

The control pressure line S is supplied with control pressure medium via an output connection S' of a shuttle valve 22. On the input side, the shuttle valve 22 is connected to an external control pressure supply G via a first input connection G', and to the working line A via a second input connection A'. The control pressure supply G has a geared pump 24 which is connected to the first input connection G' of the shuttle valve 22 via a control pressure supply line 26. The geared pump 24 is coupled to the hydraulic pump via a shaft 28 (only shown incompletely) and is therefore driven synchronously with the latter via an internal combustion engine, (not shown). The geared pump 24 sucks the pressure medium out of the tank T. The control pressure supply line 26 is, for example, fixed at 30 bar via a pressure limiting valve 30.

The shuttle valve 22 has a valve body 32 which is shown in a second switched position in FIG. 1. This position occurs if the pressure in the working line A is higher than the pressure in the control pressure supply line 26. In this case, the first input connection G' of the shuttle valve 22 is shut off, while its second input connection A' is connected to the output connection S'.

Figure 2:
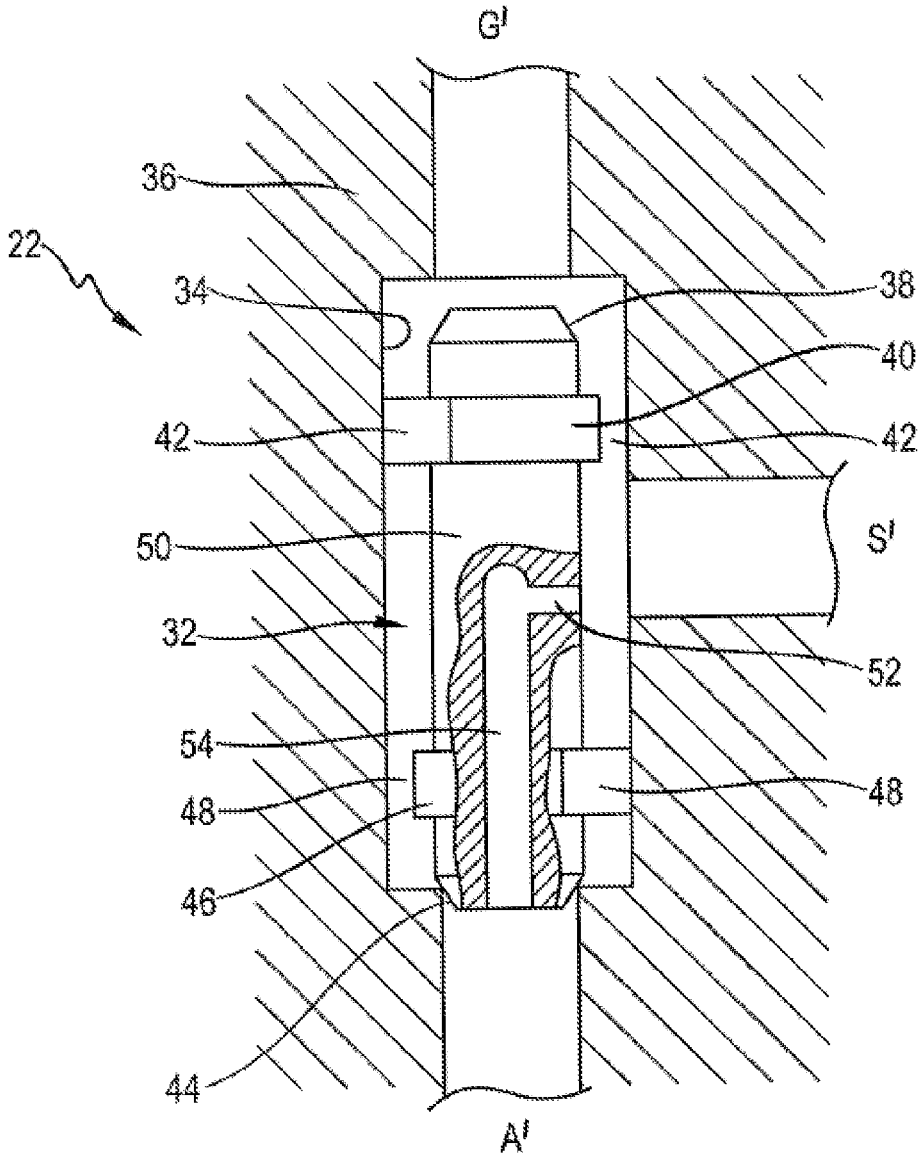
FIG. 2 shows a shuttle valve of the hydraulic pump according to the disclosure according to FIG. 1 in a partially sectional illustration.

FIG. 2 shows the shuttle valve 22 according to FIG. 1. In a valve drilled hole 34 of a housing 36, the valve body 32 is held in a displaceable fashion. Said valve body 32 has a first conical section 38 and a first guide collar which has three guide sections 40 distributed over the circumference, and also has three radially flattened portions 42 distributed over the circumference. The first conical section 38 serves to open and close the first input connection G'. Accordingly, the valve body 32 has a second conical section 44 and a second guide collar, which is likewise divided into three guide sections 46 and into three radial flattened portions 48. Between the two guide collars, the valve body 32 has a central section 50, which is stepped back radially and in the region of which the output connection S' of the shuttle valve 22 is arranged. In the region of the output connection S', a radial drilled hole is provided in the central section 50, which radial drilled hole forms a nozzle 52. Said nozzle 52 opens into a blind-hole-like longitudinal drilled hole 54 which is provided concentrically in the valve body 32 of the shuttle valve 22, starting from the second conical section 44.

FIG. 2 shows a first switched position of the shuttle valve 22 or of its valve body 32. Said switched position is achieved or switched by virtue of the fact that the pressure in the working line A or at the second input connection A' is lower than the pressure of the control pressure supply line 26 or the pressure at the first input connection G'. In this case, the second input connection A' is essentially shut off. Nevertheless, according to the disclosure, comparatively little pressure medium is delivered by the geared pump 24 to the hydraulic pump 1 via the control pressure supply line 28, the first input connection G', the three flattened portions 42, the nozzle 52, the longitudinal drilled hole 54, the second input connection A' and via the working line A. As a result, in this case pressure is also present at the inlet of the hydraulic pump 1, with the result that the latter can be lubricated even in the zero stroke operating mode and damage can be avoided.

If the valve (not shown) which is arranged in the working line A is then opened in order to supply the consumer (likewise not shown) which is connected to the working line A, the pressure (of for example 30 bar) which is built up according to the disclosure in the working line A collapses because of the nozzle 52 in valve body 32, with the result that the consumer can subsequently be started sensitively.

If the pressure, depending on the consumer, in the working line A exceeds that of the control pressure supply, the shuttle valve 22 switches from the first to the second switched position and opens a (further) restrictor-free connection from the working line A to the adjustment device. In this context, the connection, which is parallel thereto, via the nozzle 52 remains, but said nozzle 52 is comparatively insignificant in the second switched position.

A hydraulic pump with an adjustment device for adjusting the delivery volume is disclosed. The adjustment device can be connected to a control pressure supply via a shuttle valve and to a working line which is supplied by the hydraulic pump. Accordingly, the adjustment device can be supplied with control pressure alternately by the control pressure supply or the hydraulic pump. A nozzle, via which the working line is connected to the control pressure supply in the zero stroke operating mode, is formed in or on a valve body of the shuttle valve.

What is claimed is:

1. An adjustable hydraulic pump comprising:

a shuttle valve having a valve body;

an adjustment device configured to be connected via the shuttle valve to a control pressure supply and to a working line, the working line connected to the hydraulic pump; and a nozzle configured to continuously connect the working line to the control pressure supply, wherein the nozzle is in or on the valve body of the shuttle valve.

2. The adjustable hydraulic pump according to claim 1, wherein the nozzle is formed by a drilled hole.

3. The adjustable hydraulic pump according to claim 1, wherein:

the valve body has a longitudinal drilled hole, and the nozzle is formed by a radial drilled hole arranged in a central section of the valve body and which opens into the longitudinal drilled hole.

4. The adjustable hydraulic pump according to claim 1, wherein:

the valve body has a first conical section and a first guide collar adjacent to the first conical section, and the valve body has a second conical section and a second guide collar adjacent to the second conical section.

5. The adjustable hydraulic pump according to claim 4, wherein:

the shuttle valve has an output connection;

the first guide collar has at least one radial flattened portion, via which, in a first switched position of the valve body, a first pressure medium connection from the control pressure supply to the output connection is formed; and the second guide collar has at least one radial flattened portion via which, in a second switched position of the valve body, a second pressure medium connection from the working line to the output connection is formed.

6. The adjustable hydraulic pump according to claim 1, wherein the nozzle is formed by at least one notch.

7. The adjustable hydraulic pump according to claim 1, wherein the control pressure supply has a feed pump and a control pressure supply line.

8. The adjustable hydraulic pump according to claim 7, wherein:

a pressure limiting valve is connected to the control pressure supply line, and the feed pump is a geared pump.

9. The adjustable hydraulic pump according to claim 7, wherein the feed pump is an adjustment pump with pressure control.

10. The adjustable hydraulic pump according to claim 1, wherein:

the adjustment device has a first actuation cylinder configured to act in a direction of increasing the delivery volume of the hydraulic pump, the adjustment device has a second actuation cylinder configured to act in a direction of reducing the delivery volume of the hydraulic pump, the first actuation cylinder is continuously connected to an output connection of the shuttle valve, and the second actuation cylinder is configured to be connected to the output connection of the shuttle valve via a control valve.

11. The adjustable hydraulic pump according to claim 10, wherein:

the first actuation cylinder has an actuation piston, the control valve has a control valve body, and the actuation piston is coupled to the control valve body via a coupling spring.

* * * * *